United States Patent [19]

Maner

[11] Patent Number: 4,981,558

[45] Date of Patent: Jan. 1, 1991

[54] PROCESS FOR THE REPRODUCTION OF A MICROSTRUCTURED, PLATE-SHAPED BODY

[75] Inventor: Asim Maner, Linkenheim, Fed. Rep. of Germany

[73] Assignee: Kernforschungszentrum Karlsruhe GmbH, Karlsruhe, Fed. Rep. of Germany

[21] Appl. No.: 452,030

[22] Filed: Dec. 18, 1989

[30] Foreign Application Priority Data

Dec. 17, 1988 [DE] Fed. Rep. of Germany ..... 3842611

[51] Int. Cl.[5] ..... C25D 1/08

[52] U.S. Cl. ..... 204/11

[58] Field of Search ..... 204/11

[56] References Cited

U.S. PATENT DOCUMENTS 4,541,977 9/1985 Becker et al. ..... 264/102

FOREIGN PATENT DOCUMENTS 0033862 8/1981 European Pat. Off. .

3537483 4/1986 Fed. Rep. of Germany .

*Primary Examiner*—T. M. Tufariello

*Attorney, Agent, or Firm*—Sughrue, Mion, Zinn, Macpeak & Seas

[57] ABSTRACT

A process for reproducing a structured, plate-shaped body, comprising the steps of: (a) providing a composite body containing an electrically insulating molding compound layer and an electrically conducting molding compound layer, (b) pressing a first microstructured body, having an outer face, into the electrically insulating molding compound layer while applying ultrasound so that the outer face of the first microstructured body projects into the electrically conducting layer, (c) removing the first microstructured body from the composite body while applying ultrasound to form an impression in the composite body, (d) electroplating a metal into the impression in the composite body to fill the impression with metal and form a second microstructured body, and (e) removing the composite body from the second microstructured body.

13 Claims, 2 Drawing Sheets

PROCESS FOR THE REPRODUCTION OF A MICROSTRUCTURED, PLATE-SHAPED BODY

FIELD OF THE INVENTION

The present invention relates to a process for reproducing a structural, plate-shaped body, in particular, a microstructural body.

BACKGROUND OF THE INVENTION

A process for manufacturing a plurality of plate-shaped micro-structural metal bodies is disclosed in DE-PS No. 35 37 483, which is incorporated herein by reference in its entirety. According to that process, a molding tool containing a micro-structural body which is to be reproduced is used to form a female mold corresponding to the shape of the micro-structural body. The female mold is made from an electrically insulating molding compound and the molding tool is pressed into the molding compound. The molding tool containing the micro-structural body is thereafter withdrawn from the insulating molding compound to form an impression in the molding compound, and then the resulting female mold is electroplated with a metal to form a new micro-structural metal body. The female mold is then removed from the new micro-structural metal body. The molding tool can then be reused to form a new female mold and the process can be repeated.

In order to fill the female mold, fabricated in this manner and corresponding to the microstructure, with metal, the following method is proposed as an alternative in DE-PS No. 35 37 483:

The electrically insulating molding compound, which generally is a polymer, is applied to another layer comprising an electrically conducting molding compound, wherein the thickness of the electrically insulating molding compound corresponds to the height of the microstructure, so that the electrically conducting molding compound contacts the outer face of the microstructure of the tool during the course of molding.

In other words, the tool is pressed only so far into the layer comprising the electrically insulating molding compound that the outer face of the microstructure of the tool just contacts the layer comprising the electrically conducting molding compound.

The microstructure is pressed into the composite layer at 110° C., and the tool is not removed until after the microstructure or the tool has cooled.

The disclosed method is uneconomical, especially for mass production, because the temperature cycle for pressing the microstructure into the electrically insulating layer requires an additional process step and more time. The height of the layer of insulating molding compound must be adjusted precisely to the height of the microstructure of the tool. In addition to this, the electrically insulating layer can be pressed in only when it is in a liquid or viscous state with a development of relatively high forces, since otherwise the risk of damaging the microstructure of the tool is increased. The removal of the tool following the solidification of the polymer requires a similar application of more force. Therefore, releasing agents are normally mixed in with the polymer. Since during demolding the polymer is in a solid state, an extremely precise movement of the tool is necessary in order to enable demolding without damaging the tool and the female mold and to reduce the demolding forces.

SUMMARY OF THE INVENTION

An object of the present invention is to provide a process for reproducing a structural, plate-shaped body which avoids the above drawbacks.

It is a further object of the present invention to simplify the process of pressing the tool into the molding compound and subsequently withdrawing it, with the result that the force required is significantly reduced and the heating and cooling steps become unnecessary.

It is another object of the present invention to eliminate the requirement that the thickness of the layer of electrically insulating molding compound correspond to the height of the structures to be molded.

Additional objects and advantages of the present invention will be set forth in part in the description which follows and in part will be obvious from the description or can be learned by practice of the invention. The objects and advantages are achieved by means of the processes, instrumentalities and combinations particularly pointed out in the appended claims.

To achieve the foregoing objects, the present invention provides a process for reproducing a structured, plate-shaped body, which comprises the steps of: (a) providing a composite body containing comprising an electrically insulating molding compound layer and an electrically conducting molding compound layer, (b) pressing a first microstructured body, having an outer face, into the electrically insulating molding compound layer while applying ultrasound so that the outer face of the first microstructured body projects into the electrically conducting layer, (c) removing the first microstructured body from the composite body while applying ultrasound to form an impression in the composite body, (d) electroplating a metal into the impression in the composite body to fill the impression with the metal and form a second microstructured body, and (e) removing the composite body from the second microstructured body.

Preferably, the composite body is formed by the steps of (1) coating a layer of electrically insulating thermoplastic material onto an electrically conductive layer and (2) applying the electrically conductive layer to a metal plate. The electrically conductive layer preferably comprises either a thermoplastic material which contains electrically conductive particles, or an electrically conductive thermoplastic, or a low melting metal, or a low melting metal alloy.

The first microstructured body contains typically microstructures with characteristic dimensions, such as width and height in the range of one to several hundred micrometers.

The thickness of the electrical insulating layer must be smaller than the height of microstructures, so that the microstructures can penetrate about 1–100 μm into the electrical conducting layer.

Both layers together must be thicker than the height of the microstructures. The thickness of the electrical conducting layer should be at least 50 μm, typically some 100 μm.

The electrically insulating layer preferably is a thermoplastic material selected from the group consisting of polymethylmethacrylate, polycarbonate, polystyrene, polyvinyl chloride, acrylonitrile-butadiene-styrene, polyacetal and polyamine.

The thermoplastic insulating layer preferably is in a solid state when the first microstructured body is pressed into it.

The first and second microstructures preferably have the form of a honeycomb, and the electroplated metal preferably is nickel.

In one preferred embodiment of the present invention, the electroplating comprises first electroplating a layer of a first metal, then electroplating a second metal to fill the impression, and thereafter removing the first metal layer.

It is to be understood that both the foregoing general description and the following detailed description are exemplary and explanatory, but are not restrictive of the invention.

DETAILED DESCRIPTION OF THE INVENTION

Figure 1:
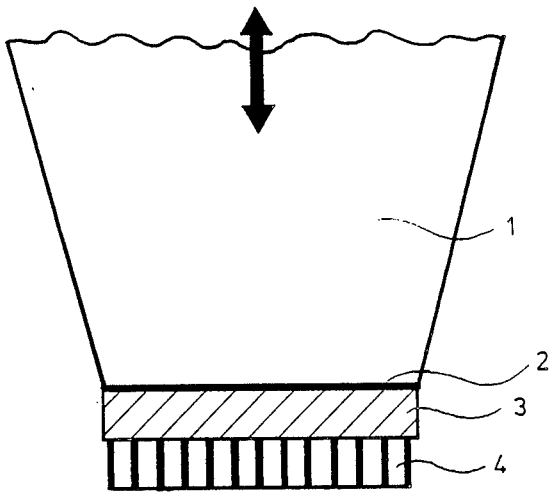
FIG. 1 is a schematic, cross-sectional view of a first microstructure body which is to be reproduced, supported on an ultrasonic welding machine, for use in accordance with one embodiment of the present invention.

In accordance with the present invention, the fabrication of a female mold is significantly simplified by providing a composite body containing an electrically insulating molding compound layer and an electrically conducting molding compound, pressing a first microstructured body, while applying ultrasonic waves (ultrasound), into the electrically insulating molding compound layer so that the faces of the first microstructural body project into the electrically conducting molding compound layer, and subsequently withdrawing the first microstructured body from the composite body, while applying ultrasonic waves, to thereby form an impression of the first microstructured body in the composite body comprised of the electrically insulating molding compound layer and electrically conducting molding compound layer.

In order to apply ultrasonic waves, commercially available ultrasonic welding machines as described in Kirk-Othmer, Chemical Technology, vol. 23, pages 470 to 472 can be used.

Preferably, the composite body is produced by coating an electrically conducting layer with a layer comprising an electrically insulating thermoplastic to form a composite layer, and then applying the electrically conducting layer to a metal plate to form a composite body. Alternatively, the composite body can be produced by applying the electrically conductive layer onto the electrically insulating layer and thereafter producing a metal plate onto the surface of the electrically conductive layer, e.g., by physical metal deposition. The electrically conducting layer can comprise a thermoplastic material which is interspersed with electrically conducting particles such as graphite, an electrically conducting thermoplastic material, a low melting metal, or a low melting metal alloy. An alloy of lead, tin and optionally bismuth is a suitable example of a low melting metal alloy. For example, Wood's alloy with 7–8 parts of Bi, 4 parts of Pb, 2 parts of Sn and 1–2 parts of Cd can be used. Examples of thermoplastic materials which can be used for the electrically insulating layer, as well as for the electrically conducting layer, are polymethylmethacrylate, polycarbonate, polystyrene, polyvinyl chloride, acrylonitrile-butadiene-styrene terpolymer, polyacetal and polyamide.

Compared to the prior art, the process of the present invention offers several significant advantages.

The thermoplastics of the composite body can be used in the solid state. A heating or cooling step is not mandatory. The force, which is necessary for pressing and for demolding the first structured body, is significantly reduced. In this manner the risk of damaging the first structured body is decreased, and the first structured body can be used for a greater number of reproduction processes. The cost of precision to insert the first structured body to precisely the interface between the electrically insulating layer and electrically conducting layer is eliminated. Rather, the first structured body is inserted so far into the composite that the faces of the structure project into the electrically conductive layer.

In many cases one may dispense with the use of releasing agents in the polymer.

Thus, the process of the present invention may be carried out significantly faster, with less cost.

The process of the present invention is explained in detail with reference to the embodiments and the FIGS. 1–4 as follows:

A first structured body in the form of a honeycomb network 4 made of nickel, which was fabricated, e.g., according to the LIGA process (deep etch x-ray lithography-microelectroforming), is to be reproduced several times. Honeycomb network 4 has a honeycomb structure, wherein the height of the honeycomb walls is 400 $\mu$m, the wall thickness is 10 $\mu$m and the honeycomb width is 100 $\mu$m.

Honeycomb network 4 forms a microstructured body whose outer dimensions are 5 cm$\times$5 cm.

First, honeycomb network 4 is connected to a stable metal plate 3 made of nickel. This can be done during the original manufacture of honeycomb network 4 by electroforming, by allowing the electroforming to continue beyond the formation of the honeycomb network and form a stable nickel layer on the honeycomb network.

Stable metal plate 3 is profiled flat by a machine on its free side, which is opposite the side where honeycomb network 4 is connected to the stable metal plate.

The flatly profiled stable metal plate 3 is then attached to a sonotrode (horn) 1 of an ultrasonic welding machine, which is normally used for melting or welding thermoplastics, by forming a soldered or cemented joint 2 between metal plate 3 and sonotrode 1, as shown in FIG. 1.

Figure 2:
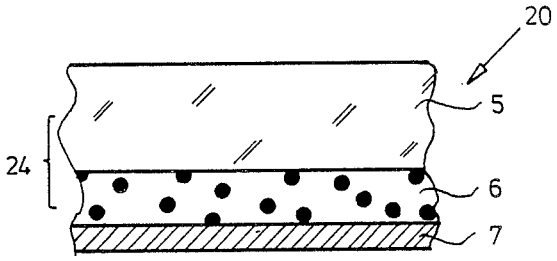
FIG. 2 is a schematic, cross-sectional view of a composite body comprised of two layers of molding compound attached to a metal plate for use in accordance with one embodiment of the present invention.

A composite body, generally 20, shown in FIG. 2, is manufactured in another process sequence. First, an electrically conductive layer 6 of non-crosslinked thermoplastic polymethylmethacrylate (PMMA), which is interspersed with electrically conductive graphite particles 22, is formed by casting on an aluminum layer 7. Electrically conductive layer 6 then is coated with an electrically insulating layer 5 made of non-crosslinked PMMA to form composite body 20. The two last layers 5 and 6 form a composite layer 24.

Figure 3:
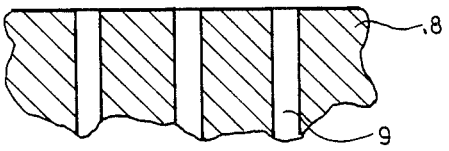
FIG. 3 is a schematic, cross-sectional view of an anvil of the ultrasonic welding machine of FIG. 1, and which contains suction openings for use in accordance with one embodiment of the present invention.

Composite body 20 is placed with its aluminum layer 7 on an anvil 8 of the ultrasonic welding machine. Anvil 8 is provided with vacuum suction openings 9, as shown in FIG. 3, and a vacuum is applied to adhere composite body 20 to the anvil.

Honeycomb network 4 is inserted into composite layer 24, containing layers 5 and 6, by bringing sonotrode 1 toward anvil 8 while applying ultrasonic waves to honeycomb network 4. Subsequently, honeycomb network 4 is withdrawn from composite layer 24 while applying ultrasonic waves to honeycomb network 4.

Figure 4:
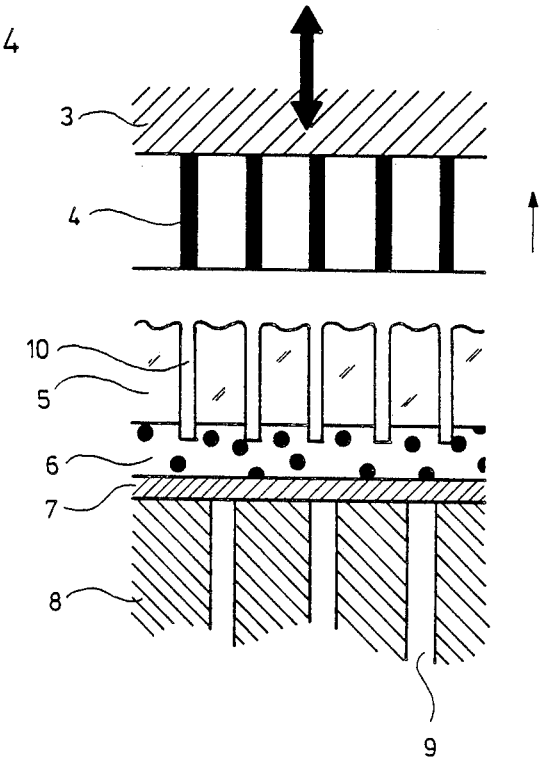
FIG. 4 is schematic, cross-sectional view of the composite body after the first microstructure body has been pressed into it and has the been withdrawn.

FIG. 4 shows an impression 10 created by honeycomb network 4 in composite layer 20. As can be seen in FIG. 4, honeycomb network 4 has pushed through electrically insulating layer 5 and has penetrated into electrically conductive layer 6.

Impression 10 created by honeycomb network 4 is subsequently electroplated with nickel, by employing composite body 20 with its impression 10 as a cathode. Composite layer 24 is subsequently removed from the electroplated nickel. This can be done by bringing composite layer 24 into contact with a solvent for the thermoplastic PMMA, such as dichloromethane, to dissolve the thermoplastic and rinse away graphite particles 22 which are embedded in electrically conductive layer 6.

However, composite layer 24 can also be removed by melting it away. In this process, aluminum layer 7 peels off.

The result is a reproduced honeycomb network made of nickel.

If graphite particles 22 still adhere to the bottom end of the reproduced nickel honeycomb network or are partially embedded in the reproduced nickel honeycomb network, the process can be modified. In this case, composite body 20 also functions as the cathode. However, first copper, and thereafter nickel, are electroplated into impression 10 created by honeycomb network 4. Composite layer 24 is then removed from the electroplated metal as above, such as by using a solvent. The new reproduced nickel and copper honeycomb network obtained in this manner then is treated with an agent for selective dissolution of copper compounds, such as a $CuCl_2$ solution, wherein the copper is selectively removed along with any graphite particles 22 which were embedded in the copper.

It will be understood that the above description of the present invention is susceptible to various modifications, changes and adaptations, and the same are intended to be comprehended within the meaning and range of equivalents of the appended claims.

What is claimed is:

1. A process for reproducing a microstructured, plate-shaped body, comprising the steps of, (a) providing a composite body containing an electrically insulating molding compound layer and an electrically conducting molding compound layer, (b) pressing a first microstructured body, having an outer face, into the electrically insulating molding compound layer while applying ultrasound so that the outer face of the first microstructured body projects into the electrically conducting layer, (c) removing the first microstructured body from the composite body while applying ultrasound to form an impression in the composite body, (d) electroplating a metal into the impression in the composite body to fill the impression with the metal and form a second microstructured body, and (e) removing the composite body from the second microstructured body.

2. The process according to claim 1, wherein the composite body is formed by the steps of (1) coating a layer of electrically insulating thermoplastic material onto an electrically conducting layer and (2) applying the electrically conducting layer to a metal plate.

3. The process according to claim 2, wherein the electrically conducting layer comprises either a thermoplastic material which contains electrically conductive particles, or an electrically conductive thermoplastic.

4. The process according to claim 2, wherein the electrically insulating layer is a thermoplastic material selected from the group consisting of a polymethylmethacrylate, polycarbonate, polystyrene, polyvinyl chloride, acrylonitrile-butadiene-styrene, polyacetal and polyamine.

5. The process according to claim 4, wherein the thermoplastic insulating layer is in a solid state when the first micro-structured body is pressed into it.

6. The process according to claim 1, wherein the electrically insulating layer is a thermoplastic material selected from the group consisting of polymethylmethacrylate, polycarbonate, polystyrene, polyvinyl chloride, acrylonitrile-butadiene-styrene, polyacetal and polyamine.

7. The process according to claim 6, wherein the thermoplastic insulating layer is in a solid state when the first micro-structured body is pressed into it.

8. The process according to claim 1, wherein the first and second microstructures have the form of a honeycomb.

9. The process according to claim 1, wherein the electroplated metal is nickel.

10. The process according to claim 1, wherein said electroplating comprises first electroplating a layer of a first metal, then electroplating a second metal to fill the impression, and thereafter removing the first metal layer.

11. The process according to claim 1, wherein the electrically conducting layer comprises a low melting metal alloy or a low melting metal layer.

12. The process according to claim 1, wherein the composite body is produced by applying the electrically conductive layer on the electrically insulating layer, and these after applying a metal plate on the surface of the electrically conductive layer.

13. The process according to claim 1, wherein the composite body is produced by applying the electrically conducting layer on a metal plate, and then applying the electrically insulating layer on the electrically conducting layer.

* * * * *